US007441611B2

(12) United States Patent
Davies et al.

(10) Patent No.: US 7,441,611 B2
(45) Date of Patent: Oct. 28, 2008

(54) PNEUMATIC ROCK DRILL

(75) Inventors: Michael R. Davies, Tranmere (AU); David J. Gee, Germiston (ZA); James Creswell, Germiston (ZA); Stephen E. Jones, Germiston (ZA)

(73) Assignee: Sulzer South Africa Limited, Elandsfontein (ZA)

( * ) Notice: Subject to any disclaimer, the term of this patent is extended or adjusted under 35 U.S.C. 154(b) by 0 days.

(21) Appl. No.: 10/548,584

(22) PCT Filed: Mar. 15, 2004

(86) PCT No.: PCT/IB2004/050254

§ 371 (c)(1),
(2), (4) Date: Feb. 23, 2006

(87) PCT Pub. No.: WO2004/080661

PCT Pub. Date: Sep. 23, 2004

(65) Prior Publication Data

US 2007/0000694 A1 Jan. 4, 2007

(30) Foreign Application Priority Data

Mar. 13, 2003 (ZA) ..... 2003/2031
Feb. 20, 2004 (ZA) ..... 2004/1404

(51) Int. Cl.
*E21B 10/38* (2006.01)

(52) U.S. Cl. ..... 175/415; 175/417; 173/199; 173/104

(58) Field of Classification Search ..... 175/414, 175/415, 417, 296; 173/104, 199
See application file for complete search history.

(56) References Cited

U.S. PATENT DOCUMENTS

| | | | | |
|---|---|---|---|---|
| 3,983,788 | A | 10/1976 | Andersson et al. | |
| 4,429,752 | A | 2/1984 | Bailey et al. | |
| 4,530,408 | A * | 7/1985 | Toutant | 173/17 |
| 4,819,746 | A * | 4/1989 | Brown et al. | 175/296 |
| 4,919,221 | A * | 4/1990 | Pascale | 175/415 |
| 2004/0060740 | A1 * | 4/2004 | Puttmann | 175/296 |

FOREIGN PATENT DOCUMENTS

| | | |
|---|---|---|
| FR | 1 231 192 A | 9/1960 |
| GB | 438 013 A | 11/1935 |
| GB | 647 023 A | 12/1950 |

* cited by examiner

*Primary Examiner*—Jennifer H Gay
*Assistant Examiner*—Daniel P Stephenson
(74) *Attorney, Agent, or Firm*—Foley & Lardner LLP

(57) ABSTRACT

A pneumatic rockdrill having a housing; a cylinder connected to a compressed air supply inlet by a set of air passages; an impact piston, at least part of which is reciprocable within the cylinder; and a controller for the supply of compressed air from the air supply inlet to the cylinder. At least one pair of contact surfaces are located at the interface between the piston and the cylinder, where those relatively moving parts contact one another. At least one water supply inlet and water paths connected to the water supply inlet(s) are configured so as in operation to convey water to a drilling tool to flush a hole being drilled, and to supply water to wet the contact surfaces.

28 Claims, 8 Drawing Sheets

FIGURE 2(SECTION A-A)

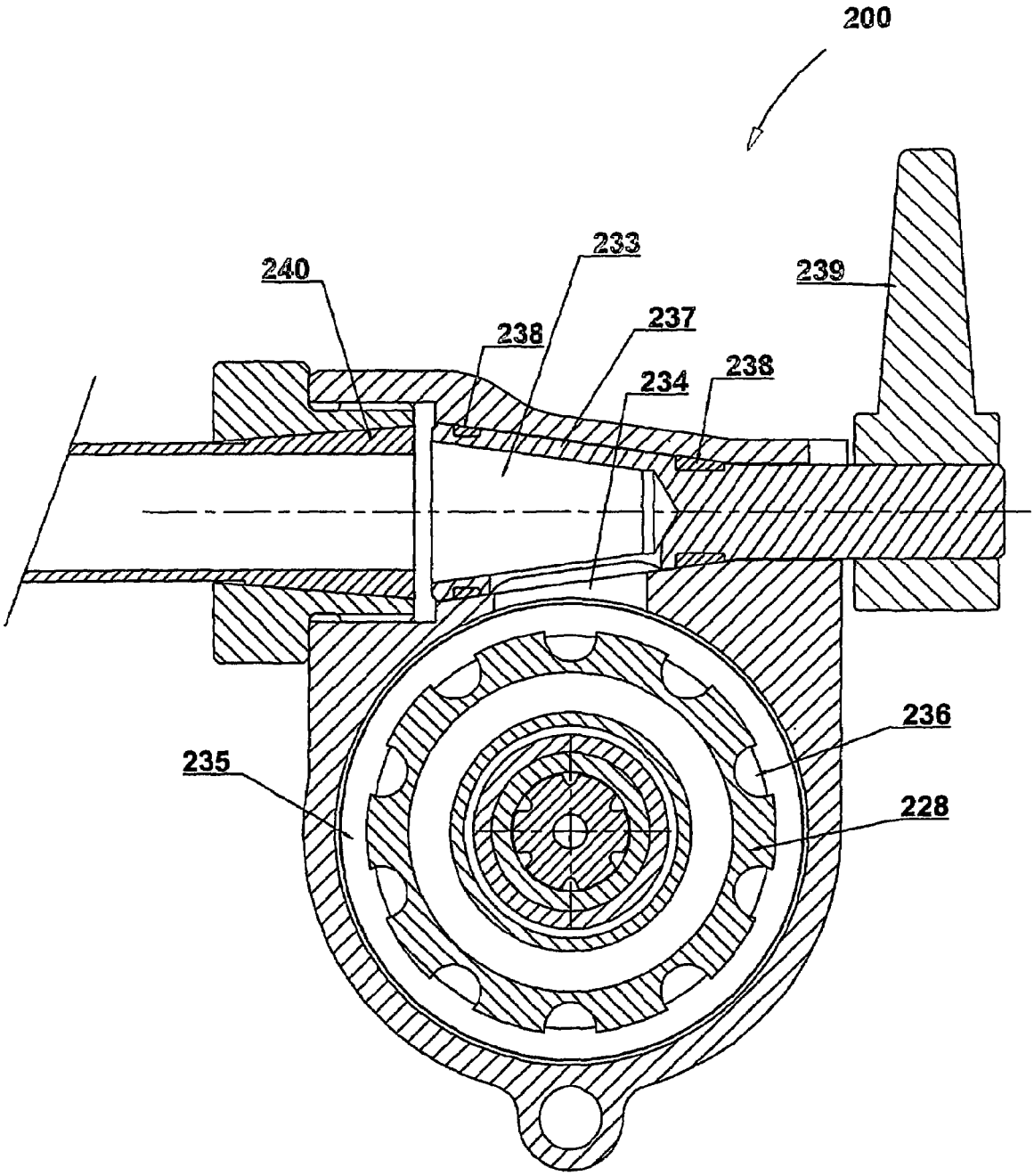
FIGURE 7 (SECTION B-B)

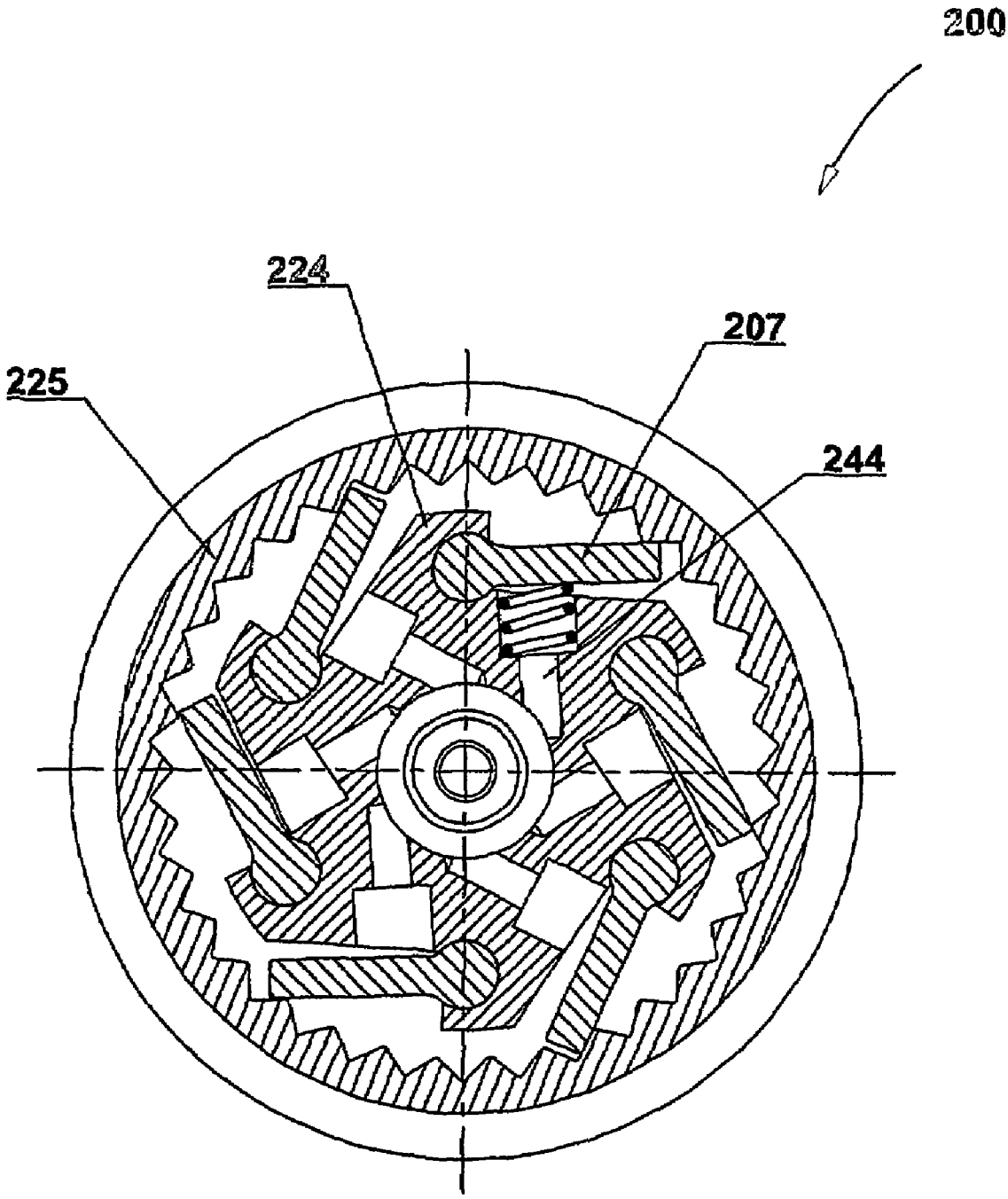
FIGURE 8 (SECTION C-C)

PNEUMATIC ROCK DRILL

TECHNICAL FIELD

This invention relates to a pneumatic reciprocating rockdrill.

BACKGROUND ART

Pneumatic percussive rockdrills are well known. Such machines typically include an impact motor containing a piston, reciprocable within a housing and configured so as in operation to deliver repeated impacts to an end of a drilling tool. Pneumatic rockdrills are also usually equipped with rotary means to rotate the drilling tool. This rotary means may be either a separate pneumatic rotary motor or a mechanical coupling from the impact motor, such as the well known rifle bar mechanism.

Pneumatic percussive rockdrills are usually also equipped with a small diameter rigid tube passing from the rear of the machine to just short of a striking face of the drilling tool. This tube passes through a hole in the centre of the piston and is more or less concentric with a hole down the centre of the drilling tool. At the rear of the machine this tube terminates in an external hose nipple. During drilling a relatively low pressure water hose is attached to the nipple, and water is injected down the rigid tube and through the hole in the drilling tool. This water exhausts from the drilling tool adjacent to the point of rock breaking during the drilling process, and serves to suppress airborne dust and to flush the broken rock fragments out of the hole being drilled. Water injection is an integral part of the drilling process, for both functional, and health and safety reasons, and therefore most underground pneumatic rock drilling sites are provided with both compressed air and a relatively low pressure water supply.

In order to lubricate these rockdrills, oil is added to the compressed air supply, typically by a venturi-type oiler. A small amount of the airborne oil entering the rockdrill is deposited on the internal surfaces, ensuring adequate lubrication. This is the well known technique of oil mist lubrication. Apart from the air passages to and from the impact and rotary motors, various secondary passages or leak paths are provided to duct air, and thus oil, to any other locations within the rockdrill which require lubrication. The oil has a secondary function of preventing corrosion of the various rockdrill components.

A large proportion of the oil entering a rockdrill of this type leaves the machine suspended in tiny droplets in the exhaust air. This is a serious health hazard to persons close to such a machine. Additional disadvantages of passing copious quantities of oil through a rockdrill are the cost of the oil and, in certain mining applications, contamination of the ore.

Various designs aimed at reducing the amount of oil passed through a pneumatic rockdrill are known. U.S. Pat. No. 3,983,788 discloses an impact motor that has two separate air circuits, one oil free and the other oiled. An enlarged central head of the impact piston is arranged to have a noticeable annular clearance within a central zone of the cylinder bore, while elongated ends of the Impact piston are guided in close fitting bushings. As a result of the annular clearance the piston can be oscillated by an oil free air supply, while the guide bushes and ancilliary components are lubricated by the second, oil laden air circuit. The vast majority of the compressed air consumed by a pneumatic rockdrill is used to reciprocate the impact piston, thus by powering this part of the machine with oil free air the amount of oil mist exhausted is significantly reduced. A disadvantage of this method is the complexity of the dual air circuits.

U.S. Pat. No. 4,333,538 discloses the use of an oil separator in the air circuit, upstream of the impact motor. A large proportion of the incoming oil is separated from the air entering the impact motor, ensuring that the minimum of oil required for lubrication passes through the impact motor. The remaining oil and some air is ducted directly to the ancilliary components of the rockdrill such as the chuck bushing and ratchet mechanism. Although not stated as an object of this invention, the more efficient distribution of the oil ought to result in an overall reduction in oil consumption and hence a reduction in the exhausted oil mist.

Also well known in the rock drilling industry are water-hydraulic percussive rockdrills. These machines use high pressure water as the working fluid instead of mineral oil as in traditional hydraulic machines. Some of the water exhausted by these machines is injected down the hole in the centre of the drilling tool to perform the dust suppression and hole flushing functions. Various design techniques and material selections have evolved to allow these rockdrills to operate successfully without any oil or grease lubrication. The only lubrication necessary is provided by the working fluid—water, and the use of suitable materials ensures that corrosion is not a significant problem. As a consequence, water-hydraulic rockdrills are completely free of the previously mentioned drawbacks of oil mist lubricated pneumatic rockdrills.

A disadvantage of water-hydraulic percussive rockdrills is that they require a different infrastructure to that of pneumatic rockdrills.

It is an object of the invention to provide a pneumatic rockdrill which seeks to overcome the abovementioned disadvantages, or which at least provides a useful alternative to existing pneumatic rockdrills.

DISCLOSURE OF INVENTION

According to a first aspect of the invention, there is provided a pneumatic rockdrill comprising:

- a housing, including an air supply inlet for receiving compressed air, and a cylinder, connected to the air supply inlet by a set of air passages;
- an impact piston, at least part of which is reciprocable within the cylinder; and
- air-flow control means for controlling the supply of compressed air from the air supply inlet to the cylinder;
- the rockdrill including at least one pair of corresponding contact surfaces at which relatively-moving parts contact one another; and the rockdrill being characterized by including at least one water supply inlet and water paths connected to the water supply inlet(s) and configured so as in operation to convey water to a drilling tool so as to flush a hole being drilled and to supply water to wet the aforesaid contact surfaces.

The contact surfaces may be at an interface between the impact piston and the cylinder. One or more bearings maybe provided to one of the cylinder and the impact piston, with the contact surfaces being surfaces on the bearing and the other of the cylinder and the impact piston.

The cylinder may include a drive chamber and a return chamber. The impact piston may include a first section and a second section, the first section having a larger diameter than the second section and being reciprocable within the cylinder. The first section of the impact piston may divide the cylinder into the drive chamber and a return chamber.

The airflow control means may be configured to control the flow of compressed air from the air supply inlet so as to intermittently supply at least one of the drive chamber and return chamber with compressed air. Preferably, the airflow control means is configured to control the supply of compressed air from the air supply inlet alternatively to the drive chamber and the return chamber.

The airflow control means may be provided by way of a valve.

The water flow paths may include a primary water flow path, configured so as in operation to supply water to the drilling tool, and at least one secondary water flow path, configured so as in operation to supply water to wet the contact surfaces.

At least one of the secondary water paths may be in fluid communication with the cylinder. Preferably, the secondary water path(s) is/are in fluid communication with both the drive chamber and the return chamber.

In operation water may be introduced into the cylinder as a result of a pressure differential between water supplied to the water supply inlet and the air in the cylinder. Water may be introduced into an exhausting chamber of the drive chamber and the return chamber as a result of the pressure differential referred to above.

In one embodiment, the rockdrill may include a venturi in an air passage near the air supply inlet, with the water paths including a passage in fluid communication with the venturi, such that in operation water is entrained in the compressed air supplied to the cylinder so as to wet the contact surfaces.

The first section of the impact piston may be located in a proximal region of the impact piston; and the cylinder provided at its longitudinal ends with piston guides, within which the impact piston is supported. The cylinder and the first section of the impact piston may be dimensioned such that there is provided a small annular clearance between the cylinder and the first section of the impact piston. The piston guides are preferably provided with sealing means, and the water paths configured so as to wet contact surfaces on the impact piston adjacent the sealing means, such that as the impact piston reciprocates, water is drawn across contact surfaces on the sealing means.

The rockdrill may include rotary means for causing, in operation, the rotation of the drilling tool.

The rotary means may include at least one pair of corresponding contact surfaces, with the water paths being configured to supply water to wet the corresponding contact surfaces of the rotary means.

The rotary means may include a clutch means. The clutch means may be located in a compartment which is in fluid communication, with the set of water paths such that in operation the compartment is water-flooded.

Alternatively, the clutch means may be located in a compartment which is in fluid communication with a supply of air in which water is entrained.

The clutch means may include a wrap spring clutch mechanism.

Alternatively, the clutch means may include a ratchet and pawl mechanism.

The rotary means may include translation means for translating the reciprocating motion of the impact piston into rotary motion. The translation means may be provided by a rifle bar mechanism.

Alternatively, the rotary means may be provided by way of a pneumatic rotary motor.

The rockdrill may include at least one passage configured so as in operation to convey moisture laden air exhausted from the cylinder to further contact surfaces, so as to wet the aforesaid contact surfaces. The rockdrill may include a chuck for imparting rotary motion to the drilling tool, and a passage configured to convey water to contact surfaces at an interface between the chuck and the housing. One or more bearings may be provided to either of the chuck and the housing, with the contact surfaces being located at the interfaces between the bearings and the other of the chuck and the housing.

The chuck may naturally comprise a single element or an assembly of elements configured to impart rotary motion from the impact piston to the drilling tool.

The passage may also be configured to convey water to contact surfaces at an interface between the impact piston and the chuck.

According to a second aspect of the invention, there is provided a method of operating a pneumatic rockdrill including a reciprocating impact piston and at least one pair of contact surfaces between relatively-moving parts, the method including the steps of:

supplying compressed air to the rockdrill so as to cause the reciprocation of the impact piston;

providing a water supply to the rockdrill; and causing water from the water supply to be exhausted through a drilling tool into a hole being drilled;

the method being characterized by the step of wetting the aforesaid contact surfaces with water from the water supply.

BRIEF DESCRIPTION OF DRAWINGS

The invention will now be described, by way of non-limiting example only, with reference to the accompanying figures, wherein:

FIG. 7 is a transverse cross sectional view through B-B as shown in FIG. 5; and FIG. 8 is a transverse cross sectional view through C-C as shown in FIG. 5.

MODES FOR CARRYING OUT THE INVENTION

Figure 1:
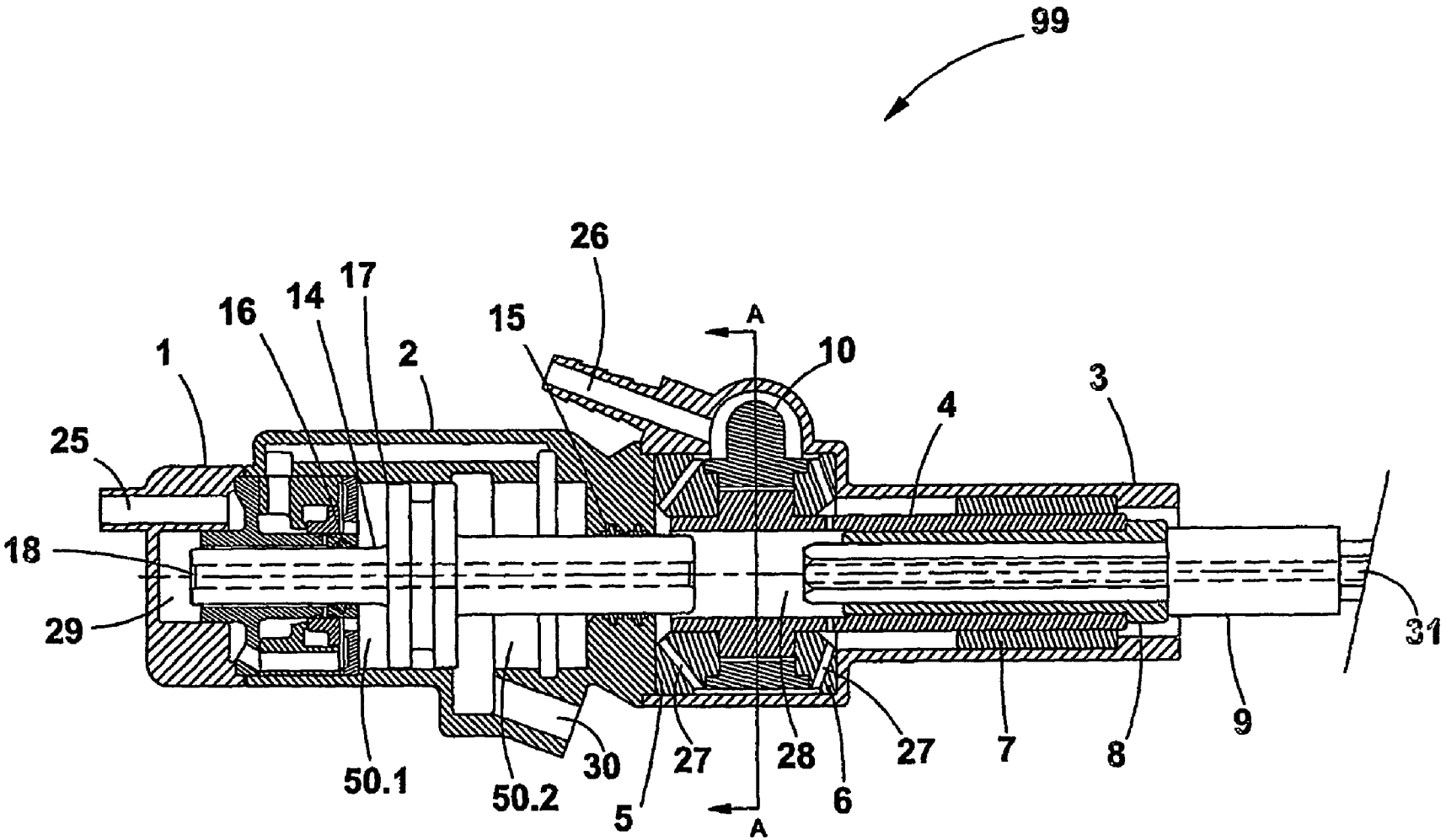
FIG. 1 is a longitudinal cross sectional view of a rockdrill according to a first embodiment of the invention.
Figure 2:
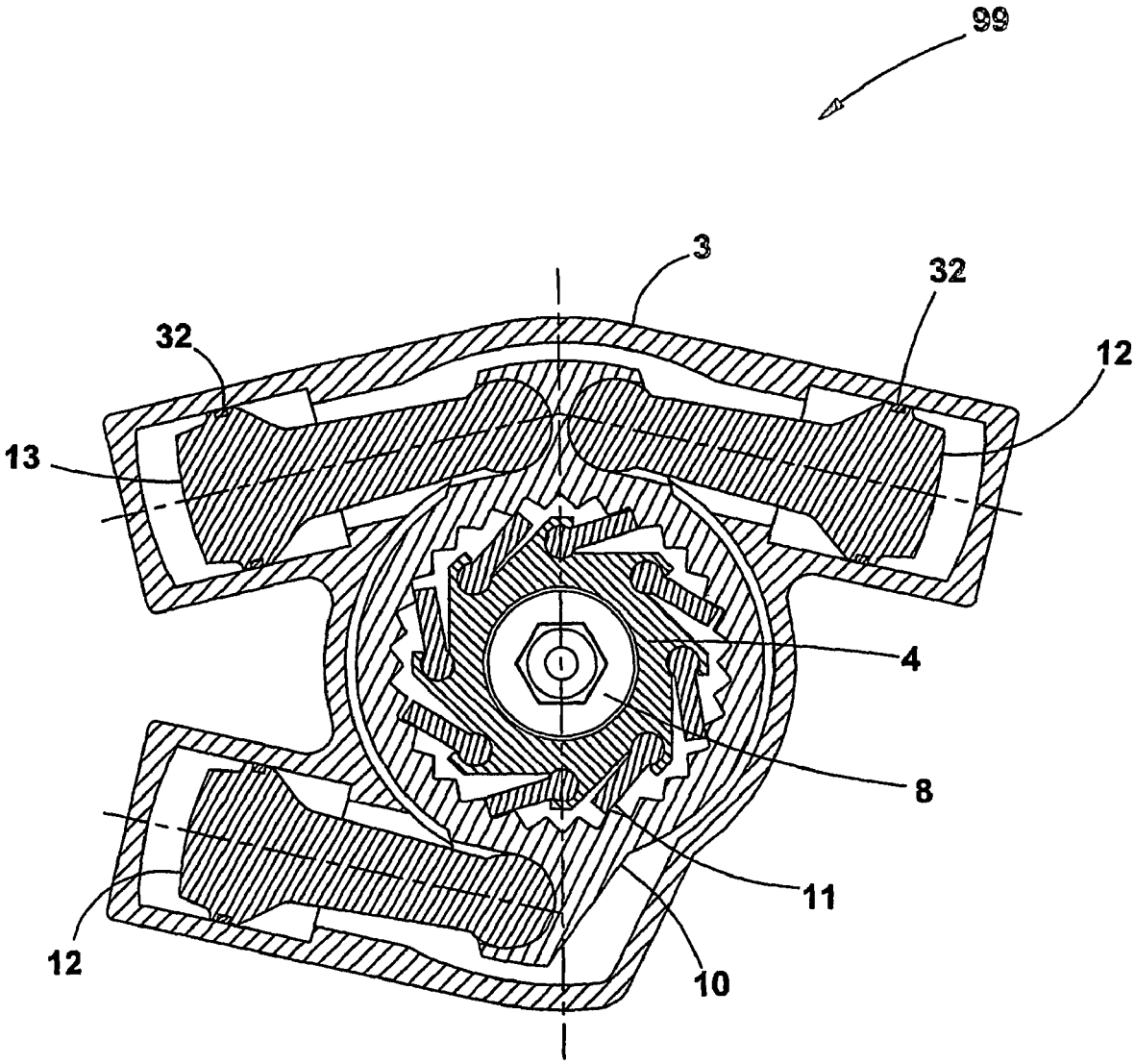
FIG. 2 is a transverse cross sectional view through A-A as shown in FIG. 1.
Figure 3:
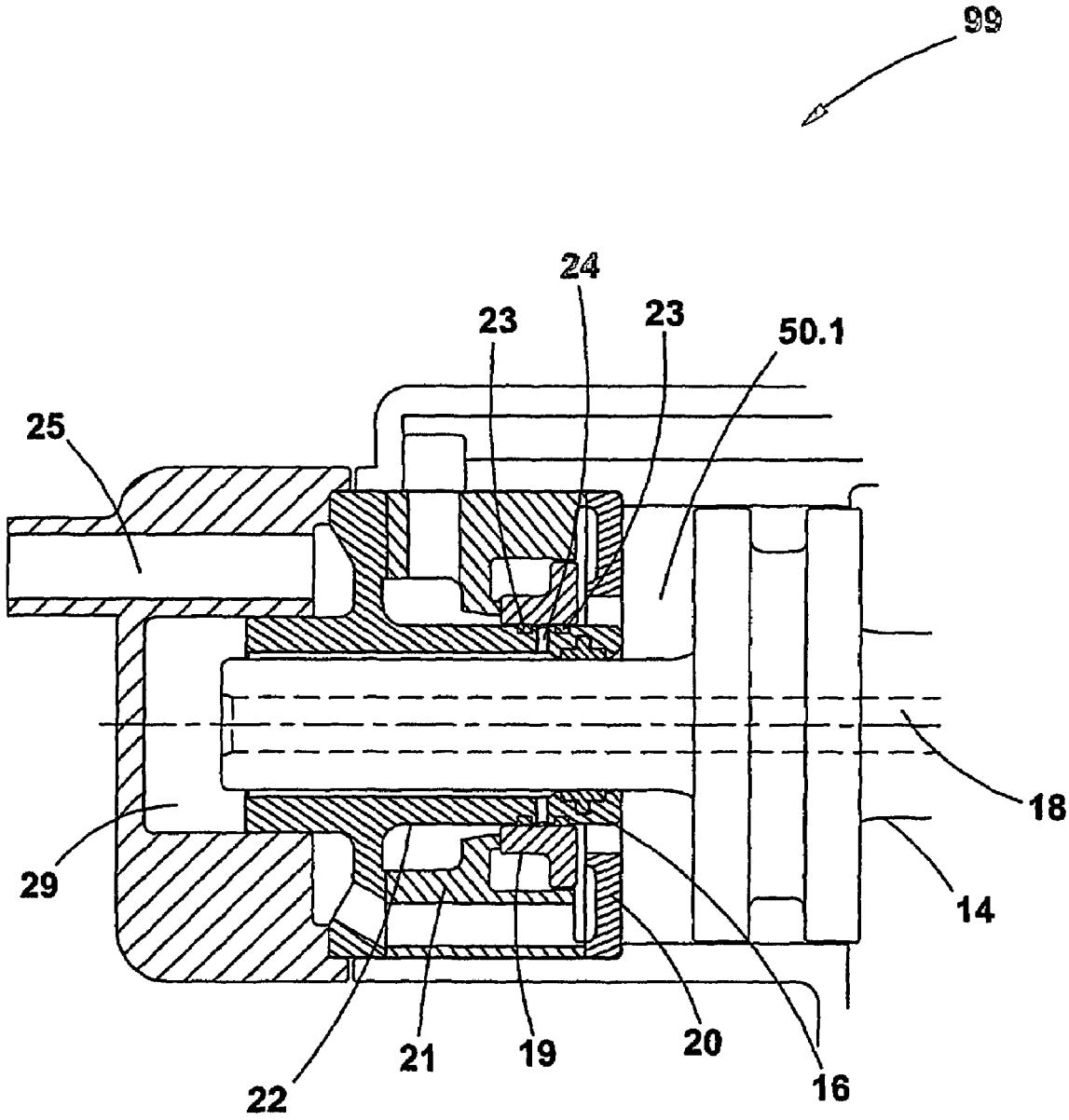
FIG. 3 is an enlarged cross sectional view of the valve area of the rockdrill shown in FIG. 1.

A rockdrill 99 in accordance with a first embodiment of the invention and as shown in FIGS. 1-3 has a housing comprising an end cap 1, a body 2, and a rotor housing 3, all preferably made from corrosion resisting or stainless steel. The body 2 includes a cylinder 50, within which an impact piston 14 is reciprocable.

A chuck 4 is free to rotate about a longitudinal axis in chuck bearings 5, 6 and 7. Chuck 4 is also axially restrained by chuck bearings 5 and 6. Chuck 4 is preferably made from a through hardened martensitic stainless steel. Chuck bearings 5, 6, 7 are preferably made from an engineering plastic such as polyester or acetal and are press fitted into bores in rotor housing 3. A hex insert 8 is fixedly connected to chuck 4 and serves to transmit rotary motion from chuck 4 to drill steel 9 as is well known. A ratchet ring 10 is free to rotate about a longitudinal axis on chuck bearings 5 and 6. Ratchet ring 10 is also axially restrained by chuck bearings 5 and 6, as shown in FIG. 1. Ratchet ring 10 is preferably made from a through hardened martensitic stainless steel. The chuck 4 is adapted to carry a series of spring loaded pawls 11 (springs not shown), configured to engage with the ratchet ring 10 as is well known. The pawls 11 are preferably made from case or through hardened steel. The ratchet ring 10 is driven in alternate directions by two indexing plungers 12 and a single reset plunger 13 as is well known. The plungers 12, 13 are equipped with seal bearings 32. The plungers 12, 13 are preferably made from acetal and the seal bearings 32 from ultra high molecular weight polyethylene, as are all seal bearings throughout the rockdrill. Such a mechanism, as used in a hydraulic rockdrill, is described in South African patent 92/4302.

The piston 14 is supported for linear motion in seal bearings 15 and 16. The seal bearings 15 and 16 are preferably energised by "O" rings. The piston 14 includes an enlarged section 17, which effectively divides the cylinder 50 into a drive chamber 50.1 and a return chamber 50.2. The enlarged section 17 of the piston 14 is of a slightly smaller diameter than the bore of the cylinder 50. There is a hole 18 right through the centre of piston 14. The piston 14 is preferably made from a through hardened martensitic stainless steel.

At the rear of the body 2 is a valve assembly consisting of a valve 19, a valve front plate 20, a valve chest 21 and a valve guide 22 as is well known. In contrast to known rockdrills though, the valve 19 is slightly elongated and is supported on a pair of seal bearings 23 mounted in recesses in valve guide 22. There is at least one hole 24 through valve guide 22 positioned between the two seal bearings 23. The valve 19 is preferably made from acetal, and the other valve components 20, 21 and 22 are preferably made from through hardened martensitic stainless steel. As an alternative the seal bearings 23 and their recesses in valve guide 22 may be omitted, and the valve 19 made with a close sliding fit over the valve guide 22.

Various ducts are included in the body 2 and valve components 20, 21, 22 such that when compressed air is supplied to inlet 25, the piston 14 and valve 19 move synchronously causing compressed air to be supplied alternatively to the drive chamber 50.1 and the return chamber 50.2, in turn causing the piston 14 to reciprocate and deliver repeated impacts to the end of drill steel 9 as is well known. Not shown are the ducts connecting the bores of plungers 12 and 13 to the air supply inlet. The location of these ducts will be obvious to one skilled in the art, and the manner in which the drill steel is indexed by the plungers 12 and 13 while the piston 14 reciprocates is well known.

The spent air exhausts from the rockdrill through exhaust port 30 as is well known.

The compressed air supply to the rockdrill has neither oil nor water added to it.

In use, a mine water service hose is connected to inlet 26 in rotor housing 3. Water enters the rotor housing 3, passes through holes 27 in chuck bearings 5 and 6, enters zone 28 inside chuck 4, passes through hole 18 in piston 14 and enters zone 29 in end cap 1. Water in zone 29 passes through holes 24 and wets the inside of valve 19 between seal bearings 23. The oscillation of the rotor components and the reciprocation of the piston 14 serves to thoroughly distribute and agitate the water present in the rotor housing 3 and zones 28 and 29. The hole 31 through the centre of the drill steel 9 is the only substantial outlet path for water which enters the drill through inlet 26. There may be secondary leak paths not shown in the figures. As a result, the water entering through inlet 26 eventually finds its way down the drill steel and out into the hole being drilled, thus performing the hole flushing and dust suppression functions. This is similar to the hole flushing technique used in current water hydraulic rockdrills, whereby the exhausted water is dumped into a zone in the rotor housing of such drills.

Careful study of the figures will show that the seal bearings 15, 16, 23, 32 serve to separate a "dry" air zone from the agitated wetted zones within the rockdrill. All bores and journals co-operating with seal bearings will be continually wetted on the "away from air" side and the mechanical components of the rotor mechanism will be thoroughly drenched. As a result of appropriate material selections and the abundant water presence, the applicant believes that satisfactory wear life should occur.

The enlarged section 17 of piston 14 does not make contact with the bore of cylinder 50 due to the previously mentioned diameter difference. The radial gap is small enough that very little air passes the enlarged section 17, while the lack of direct contact means that this interface, which is in the dry air zone, needs no lubrication. This technique is taught in U.S. Pat. No. 3,983,788.

It is not essential that the seal bearings 15, 16, 23, 24 seal perfectly. Small amounts of water which bypass the seals and enter the air stream will have no adverse effect on the operation of the rockdrill.

It will be appreciated that the various water passages shown may be varied substantially to achieve the same result. For example the water inlet 23 could be in the end cap 1 feeding into zone 29.

Figure 4:
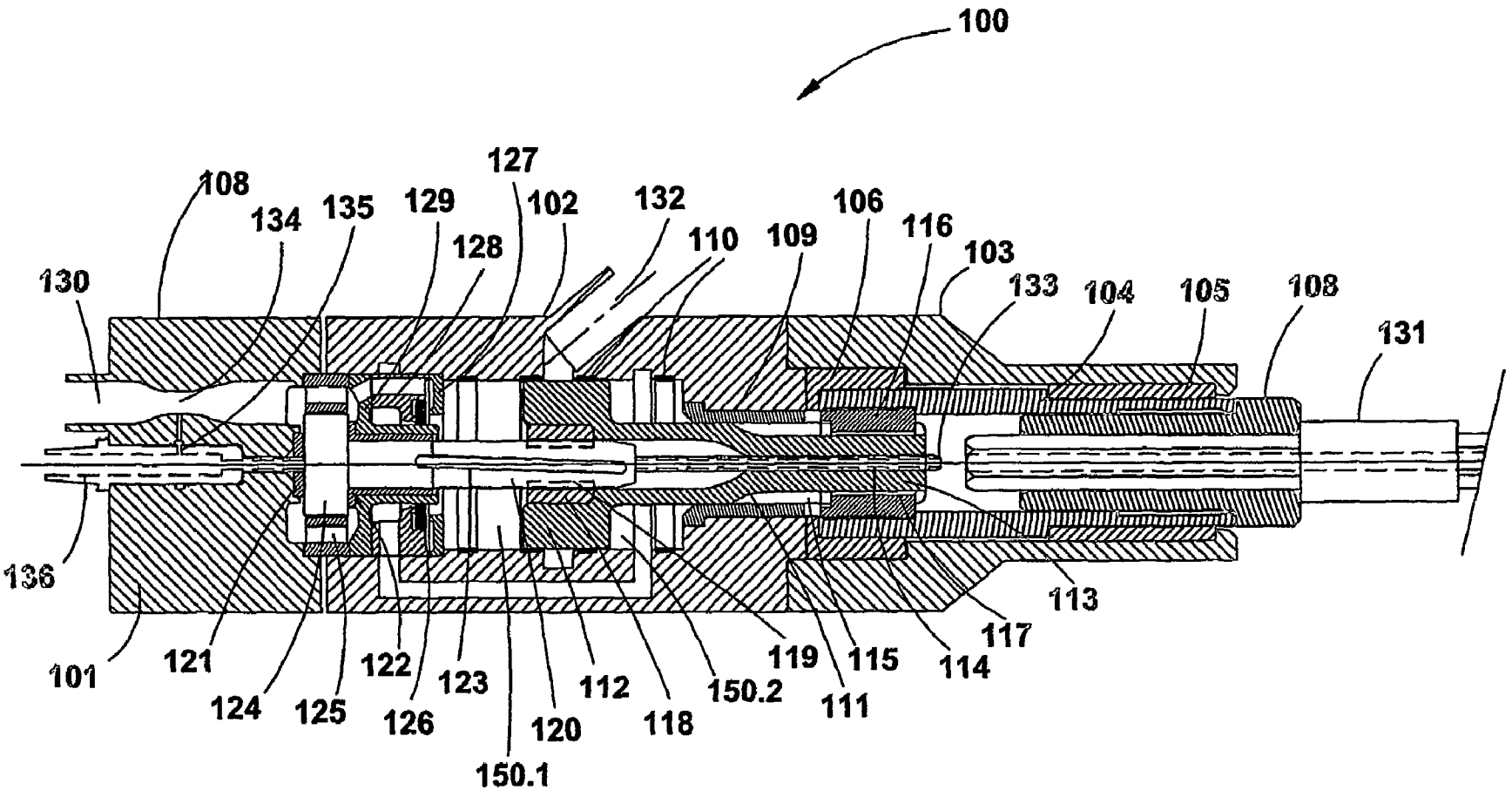
FIG. 4 is a longitudinal cross sectional view of a rockdrill in accordance with a second embodiment of the invention.

A rockdrill 100 in accordance with an alternative, second embodiment of the invention, as shown in FIG. 4, is in many respects similar to known rockdrills. Departures from known rockdrills include the substitution of corrosion resisting steels for carbon steels, engineering plastics for bronzes, as well as the addition of several plastic components to separate co-operating steel components. A fundamental difference between this rockdrill and known rockdrills is the inclusion of a small passage connecting the incoming water and compressed air supplies. By using the well known venturi principle, a small proportion of the water is entrained in the compressed air supply and distributed through the drill to wet the contact surfaces. The applicant envisages that this wetting provides for both the lubrication and cooling of the contact surfaces.

The rockdrill 100 (100 not shown in FIG. 4) has a housing comprising an end cap 101, a body 102, and a front head 103 all preferably made from corrosion resisting or stainless steel. The body 102 includes a cylinder 150, within which an impact piston piston 111 is reciprocable.

A chuck 104 is free to rotate about a longitudinal axis in chuck bearings 105 and 106. Chuck 104 is also axially restrained by chuck bearings 105 and 106. Chuck 104 is preferably made from a through hardened martensitic stainless steel. Chuck bearings 105, 106 are preferably made from an engineering plastic such as polyester or acetal and are press fitted into bores in rotor housing 103. A hex insert 108 is fixedly connected to chuck 104 and serves to transmit rotary motion from chuck 104 to drill steel 131 as is well known.

A front piston guide 109, preferably made from ultra high molecular weight polyethylene or similar engineering plastic, is press fitted into a suitable recess in front of cylinder 150. A series of seal bearings 110, preferably made from ultra high molecular weight polyethylene, are mounted in recesses in cylinder 150. Piston 111 is supported for linear motion in seal bearings 110 and front piston guide 109. The piston has an enlarged diameter head 112 and a smaller diameter stem 113. The head 112 effectively divides cylinder 150 into a drive chamber 150.1 and a return chamber 150.2. There is a small diameter hole 114 right through the piston 111. There is a set of straight external splines 115 on the forward end of piston stem 113. Seal bearings 110 sequentially engage and disengage from piston head 112 as piston 111 reciprocates in cylinder 150. The dimensions of the seal bearings 110, cylinder 150 and piston head 112 are such that piston head 112 is always engaged in at least one seal bearing 110. Seal bearings 110 tend to self energise due to their inherent flexibility and the pressure difference across them. The functioning and application of such seal bearings is described in respect of water powered hydraulic rockdrills in South African patent 97/9994. In this embodiment seal bearings are not used to seal the piston stem 113 with the cylinder 150, as the splines 115 probably make such seal bearings unsuitable.

A chuck nut 116, preferably made from acetal or similar engineering plastic, is fixedly connected to chuck 104. There is a set of straight internal splines 117 in chuck nut 116 which co-operate with the external piston splines 115. As a result the piston 111 is rotationally coupled to the chuck 104 as is well known.

A rifle nut 118, preferably made from acetal or similar engineering plastic is fixedly connected to a recess in the piston head 112. There is a set of helical internal spines 119 in rifle nut 118.

A rifle bar 120, preferably made from through hardened martensitic stainless steel, is free to rotate in bearing 122 press fitted in valve guide 129. Rifle bar 120 is also axially restrained by bearings 121, 122. Bearings 121, 122 are preferably made from acetal or similar engineering plastic. There is a set of external helical splines 123 on rifle bar 120 which co-operate with internal rifle nut splines 119. There is a set of spring loaded pawls (not shown in FIG. 4) carried in enlarged diameter rear end 124 of rifle bar 120. The pawls are preferably made from case or through hardened steel.

A ratchet ring 125, preferably made from a case or through hardened steel, is fixedly mounted in rear of the body 102. Ratchet ring 125, rifle bar 120, pawls, chuck nut 116 and rifle nut 118 all combine to deliver a stepped rotary motion to the chuck 104 as the piston 111 reciprocates as is well known.

At the rear of the body 102 is a valve assembly comprising of a valve 126 and a valve front plate 127, a valve chest 128 and a valve guide 129 as is well known. The valve 126 is preferably made from acetal or similar engineering plastic, and the other valve components are preferably made from through hardened martensitic stainless steel.

Various ducts and flow paths are included in end cap 101, body 102, valve components 127, 128, 129 and ratchet ring 125 such that, when compressed air is supplied to inlet 130, the piston 111 and valve 126 move synchronously causing compressed air to be supplied alternatively to the drive chamber 150.1 and the return chamber 150.2, in turn causing the piston 111 to reciprocate and deliver repeated impacts to the end of drill steel 131 as is well known. The spent air exhausts from the rockdrill 100 through exhaust port 132 as is well known.

A rigid water tube 133 extends from the rear of the rockdrill 100, through holes in the center of the piston 111 and rifle bar 120 and ends just short of the drill steel 131 as is well known. For clarity the water tube 33 is not shown through the rifle bar 120 in FIG. 4. In use a mine service water hose is connected to a nipple at the end of water tube 133.

There is a venturi 134 formed in the inlet 130 and an aperture 135 which connects a slightly enlarged diameter section 136 of the water tube 33 to throat of venturi 134. By taking note of typical water and compressed air pressures, and careful sizing of the venturi throat 134, aperture 135 and water tube section 136, a small portion of the incoming flushing water is entrained in the compressed air in inlet 130. The applicant believes that the water mist laden air thus lubricates the rock drill components in the same way that the oil mist laden air does in known rockdrills.

Hole flushing is accomplished by that portion of the incoming water not entrained in the incoming compressed air. This water is ejected from the end of the water tube 133 in the form of a fairly high speed jet, which directly enters the hole down the centre of drill steel 131 as is well known.

Not shown in FIG. 4 is a combination start valve which simultaneously shuts off and opens the water and compressed air supplies.

Also not shown in the figure, but well known in the art are additional passages which duct moisture laden air to the chuck bearings 105 and 106.

There is thus described a water-mist lubricated rock drill which has a venturi in the incoming air line, and a passage connecting the flushing water supply and the throat of the venturi. The air pressure in the throat of the venturi is lower than the flushing water supply pressure, and as a consequence a small amount of water is drawn into the air stream. This water then lubricates the contact surfaces of the rockdrill.

Typical mine water and air supply pressures are similar (nominally around 500 kPa), and can be expected to vary somewhat from mine to mine, and also at different locations within any given mine. Air and water supply pressures in the range of 400 kPA to 600 kPa are not atypical.

There is a limit to how low one can drop the venturi pressure before incomplete pressure recovery downstream of the venturi throat causes unacceptable drill power losses. The applicant's experience was that if the venturi was sized to give acceptable drill performance, the pressure drop in the throat would be quite small—of the order of 100 kPa at 500 kPa air supply pressure. A pressure drop of this magnitude is insufficient when compared with the possible air and water supply pressure variations, and the amount of water injected could vary from zero (air entering the water circuit) to much more than necessary.

Thus, where air and water supply pressures vary, the third embodiment described below is preferable to this second embodiment.

A rockdrill 200 in accordance with a third, preferred embodiment is shown in FIGS. 5-8.

Much of this rockdrill 200 is again very similar to known rockdrills. Departures from known rockdrills again include the substitution of corrosion resisting steels for carbon steels, engineering plastics for bronzes, as well as the addition of several plastic components to separate co-operating steel components.

The rockdrill 200 has a housing comprising an end cap 201, a body 202, and a front head 203 all preferably made from corrosion resisting or stainless steel. The body includes a cylinder 290, within which an impact piston 211 is reciprocable.

A chuck 204 is free to rotate about a longitudinal axis in chuck bearings 205 and 206. Chuck 204 is also axially restrained by chuck bearings 205 and 206. Chuck 204 is preferably made from through hardened martensitic stainless steel. Chuck bearings 205, 206 are preferably made from an engineering plastic such as polyester or acetal and are press fitted into bores in front head 203. A hex insert 208 is fixedly connected to chuck 204 and serves to transmit rotary motion from chuck 204 to drill steel 207 as is well known.

A front piston guide 209, preferably made from ultra high molecular weight polyethylene, acetal or similar engineering plastic, is press fitted into a suitable recess in the front of cylinder 290. A series of seal bearings 210, preferably made from ultra high molecular weight polyethylene, are mounted in recesses in cylinder 290. A piston 211 is supported for linear motion in seal bearings 210 and front piston guide 209. The piston has an enlarged diameter head 212 and a smaller diameter stem 213. The head 212 divides the cylinder into a drive chamber 230 and a return chamber 231. The diameter of piston stem 213 is very slightly smaller than the inside diameter of front piston guide 209. There is a small diameter hole 214 right through the piston 211. There is a set of straight external splines 215 on the forward end of piston stem 213. Seal bearings 210 sequentially engage and disengage from piston head 212 as piston 211 reciprocates in cylinder 290. The dimensions of the seal bearings 210, cylinder 290 and piston head 212 are such that piston head 212 is always engaged in at least one seal bearing 210. Seal bearings 210 tend to self energise due to their inherent flexibility and the pressure difference across them. The functioning and application of such seal bearings, as used in hydraulic rockdrills, is described in South African patent no. 97/9994.

A chuck nut 216, preferably made from acetal or similar engineering plastic, is fixedly connected to chuck 204. There is a set of straight internal splines 217 in chuck nut 216 which co-operate with the external piston splines 215. As a result the piston 211 is rotationally coupled to the chuck 204 as is well known.

Figure 5:
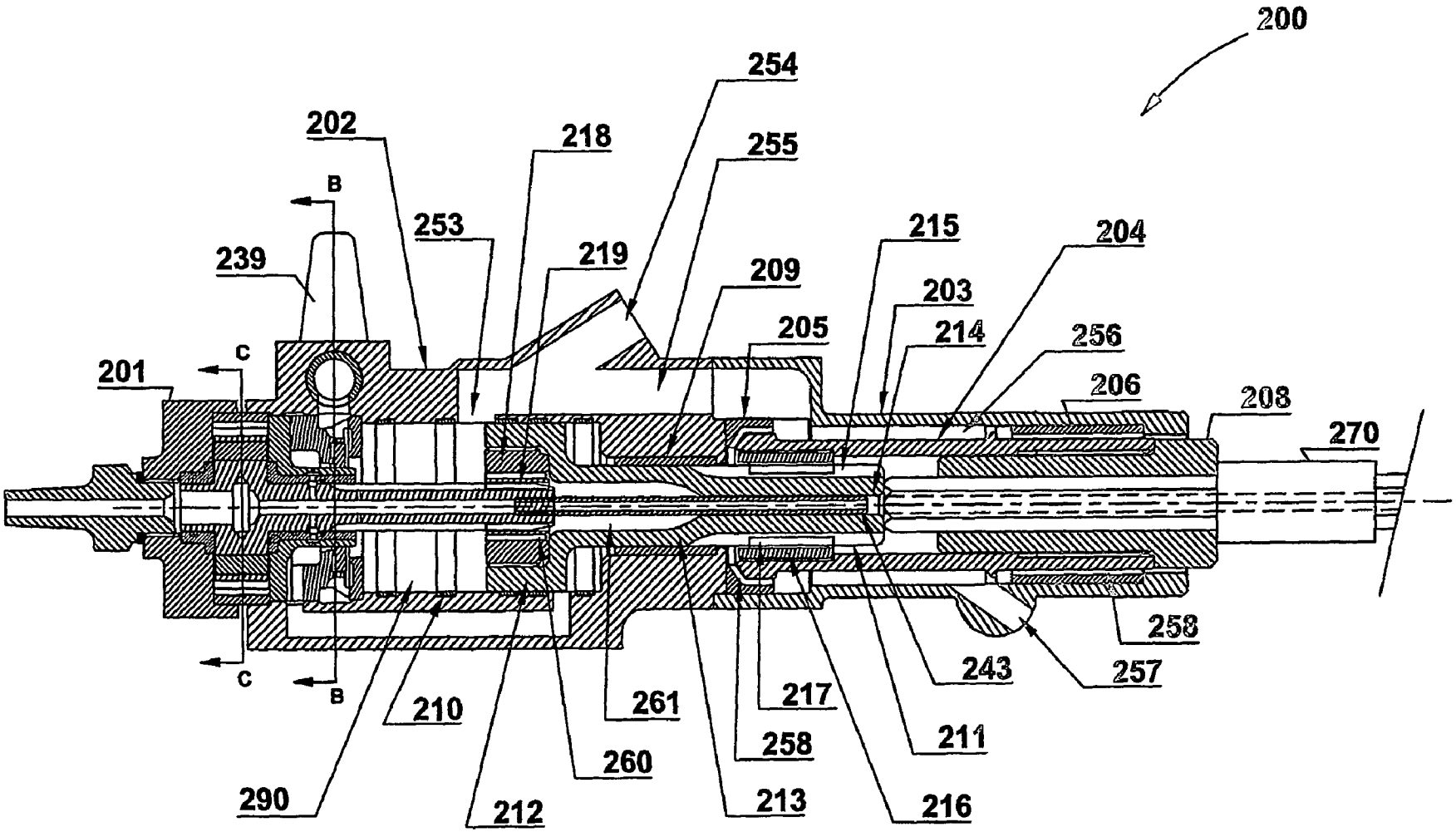
FIG. 5 is a longitudinal cross sectional view of a rockdrill according to a third embodiment of the invention.
Figure 6:
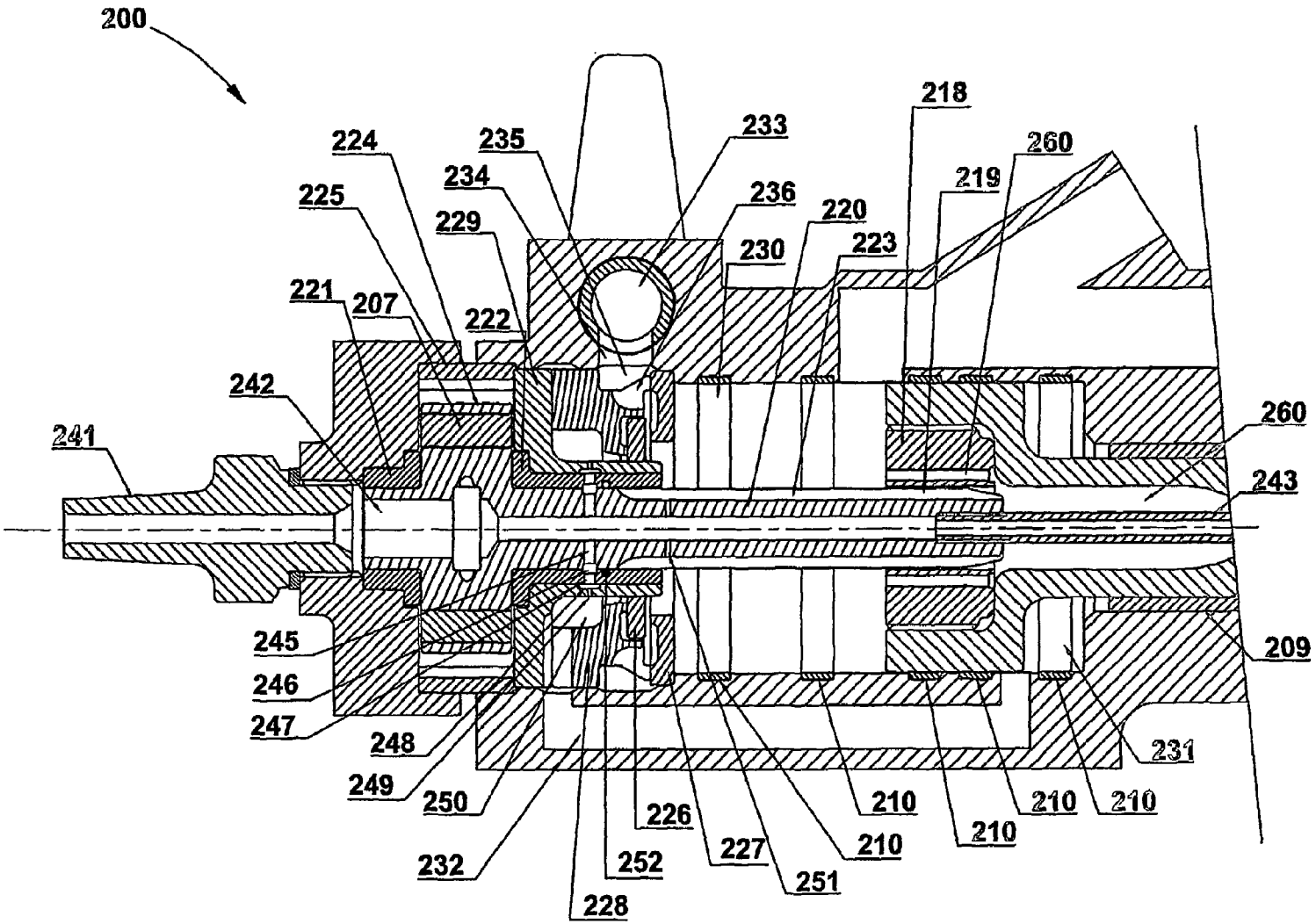
FIG. 6 is an enlarged cross sectional view of the valve area of the rockdrill shown in FIG. 5.

A rifle nut 218, preferably made from acetal or similar engineering plastic is fixedly connected to a recess in piston head 212. There is a set of helical internal splines 219 in rifle nut 218. (Note that FIGS. 5 and 6 are not strictly correct, in that splines 219 are shown as straight for convenience) There are a series of radially spaced holes 260 through riflenut 218 which prevent air being trapped and compressed in cavity 261 as piston 211 reciprocates. The addition of these holes 260 solved a problem of excessive heat causing riflenut 218 to fail.

A rifle bar 220, preferably made from through hardened martensitic stainless steel, is free to rotate in bearings 221 and 222 press fitted in end cap 201 and valve guide 229 respectively. Rifle bar 220 is also axially restrained by bearings 221, 222. Bearings 221, 222 are preferably made from acetal or similar engineering plastic. There is a set of external helical splines 223 (Note that FIGS. 5 and 6 are not strictly correct, in that splines 223 are shown as straight for convenience) on rifle bar 220 which co-operate with internal rifle nut splines 219. There is a set of spring loaded pawls 207 (only one set of springs shown) carried in enlarged diameter rear end 224 of rifle bar 220. The pawls are preferably made from case or through hardened steel.

A ratchet ring 225, preferably made from a through hardened martensitic stainless steel is fixedly mounted in rear of body 202. Ratchet ring 225, rifle bar 220, pawls 207, chuck nut 216 and rifle nut 218 all combine to deliver a stepped rotary motion to the chuck 204 as the piston 211 reciprocates as is well known.

At the rear of the body 202 is a valve assembly consisting of a valve 226 and a valve front plate 227, a valve chest 228 and a valve guide 229 as is well known. The valve 226 is preferably made from ultra high molecular weight polyethylene, acetal or similar engineering plastic and the other valve components are preferably made from through hardened martensitic stainless steel.

An on/off valve assembly 233 is mounted in a transverse bore above the valve chest 228 and, when in the on position, admits compressed air through inlet port 234 into an annular cavity 235 formed around the outside of valve chest 228. There are a series of cut-outs 236 spaced radially around valve chest 228 which allow compressed air to pass from annular cavity 235 to valve 226. The valve 226 serves to admit compressed air to either the drive chamber 230 or, via annular zone 250 and transfer port (or ports) 232, to the return chamber 231, depending upon the valve's 226 position as is well known. The piston 211 and valve 226 move synchronously causing the piston 211 to reciprocate and deliver repeated impacts to the end of drill steel 270 as is well known.

The on/off valve assembly 233 includes a tumbler 237 preferably made from through hardened martensitic stainless steel supported on a pair of bearings 238 preferably made from acetal or similar engineering plastic. The tumbler is rotated between an on and an off position by a hand lever 239. Apart from the material choices and the bearings 238, the on/off valve arrangement is well known. Compressed air is supplied to the rockdrill by an air line (not shown) attached to swivel connection 240 as is well known.

There is a nipple 241 mounted in end cap 201, conveniently, but not essentially on the drill centreline. In use a water hose (not shown) is connected to nipple 241. There is a bore 242 down the centre of riflebar 220. A rigid, or semi-rigid tube 243 is fixedly connected to the end of bore 242 nearest the drill steel 270. Tube 243 is preferably made from nylon or similar engineering plastic. Tube 243 passes through hole 214 in the centre of piston 211, and ends just shy of the impact face of drill steel 270. Thus in use water is able to pass through rifle bar 220, tube 243 and into the hole down the centre of drill steel 270 to perform the well known dust suppression and hole flushing functions.

There is a series of holes 244 (only visible in FIG. 8) spaced radially around the enlarged diameter portion 224 of riflebar 220. These holes 244 allow water to pass from bore 242 into the region occupied by the pawls 207 and ratchet ring 225. During use the pawls are thus continually immersed in water.

There is a series of radially spaced holes 245 through riflebar 220 which connect bore 242 to an annular cavity 246 formed between riflebar 220 and riflebar bearing 222. There is a series of radially spaced holes 247 in riflebar bearing 222 which connect annular cavity 246 with annular cavity 248 formed between riflebar bearing 222 and valve guide 229. There is a series of radially spaced holes 249 which connect annular cavity 248 with annular cavity 250 formed between valve guide 229 and valve chest 228. Annular cavity 250 is connected, via transfer port/ports 232 to piston return chamber 231. Thus the piston return chamber 231 is at all times in communication with bore 242. The total area of holes 249 is very much less than the total area of holes 245, the total area of holes 246 and the areas of annular cavities 246 and 248. Thus the amount of flow (either water or air depending on their respective pressures) between bore 242 and piston return chamber 231 is controlled by the size and number of holes 249.

There is a further series of radially spaced holes 251 in riflebar 220 which at all times connect bore 242 directly to piston drive chamber 230. The total area of holes 251 is similar to the total area of holes 249. There is an O-ring (or similar seal) 252 between riflebar 220 and riflebar bearing 222 adjacent to annular cavity 246 to prevent flow from annular cavity 246 to drive chamber 230.

The series of radially spaced holes 251 and 249 connect the flushing water supply to the piston drive and return chambers respectively.

There is an exhaust port 253 in approximately the centre of cylinder 250 as is well known. The exhaust port 253 is split, with an immediate exit to atmosphere 254, and an extension 255 which leads into front head 203. The exhaust port extension 255 communicates with an annular cavity 256 surrounding the chuck 204. There is an opening/openings 257 which connect annular cavity 256 to atmosphere. Chuck bearings 205 and 206 have a series of radially spaced grooves 258 which ensure that moisture laden exhaust air wets the full contact area of chuck bearings 205 and 206, and the contact surfaces between chuck nut 216 and the piston 211.

The applicant believes that this third embodiment overcomes the shortcomings of the above second embodiment by introducing the necessary water for lubrication and cooling into regions of the drill which, for at least some of the time, are filled with air at a much lower, and more constant pressure than the water supply pressure.

As the rockdrill 200 cycles, the piston drive chamber 230 and return chamber 231 are alternated between a "high" pressure, related to the air supply pressure (and similar to the water supply pressure), and a "low" pressure, related to atmospheric pressure, (and significantly lower than the water supply pressure) depending on the position of the valve 226 and piston 211. Irrespective of the air supply pressure, the "low" pressure is more or less constant.

Two appropriately sized ports (or groups of ports), described in this description as the holes 251 and 249, connect the flushing water supply to the piston drive chamber 230 and piston return chamber 231 respectively, either directly or indirectly depending on the position of the ports (or groups of ports). The two ports (or groups of ports) are conveniently, but not necessarily placed on either side of, and adjacent to, the valve 226.

When a particular chamber (drive or return) is at "high" pressure there is a nominal flow of water or air through the relevant port (or group of ports) depending on the difference between the water supply pressure and the "high" pressure. If the "high" pressure is higher than the water supply pressure, a small amount of air flows into the flushing water, which is of little significance. If the "high" pressure is lower than the water supply pressure a small amount of water flows into that particular chamber to contribute to the lubrication and cooling of the contact surfaces.

When a particular chamber (drive or return) is at "low" pressure a relatively large volume of water flows through the relevant port (or group of ports) into that particular chamber and provides the bulk of the lubrication and cooling requirement of the contact surfaces. Sufficient water is injected to ensure that the contact surfaces remain wetted during the "high" pressure phase when no or minimal water is injected.

Since the "low" pressure is more or less constant the resulting water flow is more or less independent of the air supply pressure. Also, because the difference between nominal water supply pressure and the "low" pressure is quite large relative to typical variations in water supply pressure, the water flow is not significantly affected by such variations in water supply pressure.

As indicated above, some or all of the moisture laden exhaust air is ducted through extension passage 255 and annular cavity 256 to provide water to wet the chuck bearings 205 and 206 before exhausting to atmosphere.

Therefore, by introducing the water downstream of the valve, as opposed to upstream as in the second embodiment described above, the applicant takes advantage of a much more constant air pressure, and a far bigger overall pressure difference between the water and air than is possible using a venturi.

It will be appreciated that aspects of this third embodiment could equally well be embodied in a rockdrill with an opposed plunger actuated rotor as in the first embodiment described above, instead of the riflebar type rotation described hereinabove.

Each of the embodiments described above thus provide a water-lubricated oil free rockdrill.

Although all the embodiments described above use a ratchet and pawl clutch mechanism, a wrap spring clutch mechanism, such as that described in South African patent no. 92/2561, could equally be used.

Further, although all the embodiments described above include a valve member distinct from the piston, the invention could also be applied in rockdrills using different air switching systems, such as "valveless" drills.

The invention claimed is:

1. A pneumatic rockdrill comprising:

a housing, including an air supply inlet for receiving compressed air, and a cylinder connected to the air supply inlet by a set of air passages;

an impact piston, at least part of which has an interface with and is reciprocable within the cylinder;

airflow control means for controlling the supply of compressed air from the air supply inlet to the cylinder;

a water supply inlet adapted in operation to convey water to a drilling tool so as to flush a hole being drilled;

at least one pair of corresponding contact surfaces at the interface where the relatively moving impact piston and the cylinder contact one another; and water paths connected to the water supply inlet so that at least the interface between the impact piston and the cylinder is supplied with lubricating water or lubricating water-laden air.

2. A rockdrill according to claim 1, wherein a bearing is provided to one of the cylinder and the impact piston, with the contact surfaces being surfaces on the bearing and the other of the cylinder or the impact piston.

3. A rockdrill according to claim 1, wherein the impact piston includes a first section and a second section, the first section having a larger diameter than the second section and being reciprocable within the cylinder.

4. A rockdrill according to claim 3, wherein the cylinder includes a drive chamber and a return chamber, and wherein the airflow control means is provided by way of a valve and is configured to control the flow of compressed air from the air supply inlet so as to intermittently supply at least one of the drive chamber and return chamber with compressed air.

5. A rockdrill according to claim 1, wherein the water paths include a primary water path, configured so as in operation to supply water to the drilling tool, and at least one secondary water path, configured so as in operation to supply water to wet the contact surfaces.

6. A rockdrill according to claim 5, wherein at least one of the secondary water paths is in fluid communication with the cylinder.

7. A rockdrill according to claim 6, wherein the secondary water path(s) is/are in fluid communication with both the drive chamber and the return chamber.

8. A rockdrill according to claim 5, wherein in operation water is introduced into the cylinder as a result of a pressure differential between water supplied to the water supply inlet and the air in the cylinder.

9. A rockdrill according to claim 8, wherein the cylinder includes a drive chamber and a return chamber, and wherein in operation water is introduced into an exhausting chamber of the drive chamber and the return chamber as a result of a pressure differential between the water supply and the air in the exhausting chamber.

10. A rockdrill according to claim 1, including a venturi in an air passage near the air supply inlet, and wherein the water paths include a passage in fluid communication with the venturi, such that in operation water is entrained in the compressed air supplied to the cylinder so as to wet the contact surfaces.

11. A rockdrill according to claim 4, wherein the first section of the impact piston is located in a proximal region of the impact piston; and wherein the cylinder is provided at its longitudinal ends with piston guides, within which the impact piston is supported.

12. A rockdrill according to claim 11, wherein the cylinder and the first section of the piston are dimensioned such that there is provided a small annular clearance between the cylinder and the first section of the impact piston.

13. A rockdrill according to claim 11, wherein the piston guides are provided with sealing means.

14. A rockdrill according to claim 13, wherein the water paths are configured to wet contact surfaces on the impact piston adjacent the sealing means, such that as the impact piston reciprocates, water is drawn across contact surfaces on the sealing means.

15. A rockdrill according to claim 1, including rotary means for causing, in operation, the rotation of the drilling tool.

16. A rockdrill according to claim 15, wherein the rotary means includes at least one pair of corresponding contact surfaces, with the water paths being configured to supply water to wet the corresponding contact surfaces of the rotary means.

17. A rockdrill according to claim 16, wherein the rotary means includes a clutch means.

18. A rockdrill according to claim 17, wherein the clutch means is located in a compartment which is in fluid communication with the set of water paths such that in operation the compartment is water-flooded.

19. A rockdrill according to claim 17, wherein the clutch means is located in a compartment which is in fluid communication with a supply of air in which water is entrained.

20. A rockdrill according to claim 17, wherein the clutch means includes a wrap spring clutch mechanism.

21. A rockdrill according to claim 17, wherein the clutch means includes a ratchet and pawl mechanism.

22. A rockdrill according to claim 15, wherein the rotary means includes translation means for translating the reciprocation motion of the impact piston into rotary motion.

23. A rockdrill according to claim 22, wherein the translation means is provided by a rifle bar mechanism.

24. A rockdrill according to claim 15, wherein the rotary means is provided by way of a pneumatic rotary motor.

25. A rockdrill according to claim 6, including at least one passage configured so as in operation to convey moisture laden air exhausted from the cylinder to further contact surfaces, so as to wet the aforesaid further contact surfaces.

26. A rockdrill according to claim 25, including a chuck for imparting rotary motion to the drilling tool, wherein the passage is configured to convey water to contact surfaces at an interface between the chuck and the housing.

27. A rockdrill according to claim 25, including a chuck for imparting rotary motion to the drilling tool, wherein the passage is configured to convey water to contact surfaces at an interface between the impact piston and the chuck.

28. A method of operating a pneumatic rockdrill including a cylinder, an impact piston, at least a part of which is reciprocable within the cylinder, and at least one pair of contact surfaces at an interface between the piston and the cylinder, the method including the steps of:

supplying compressed air to the rockdrill so as to cause reciprocation of the impact piston;

providing a water supply to the rockdrill;

causing water to be exhausted through a drilling tool into a hole being drilled; and wetting said contact surfaces with water so that at least the interface between the impact piston and the cylinder is supplied with lubricating water or lubricating water-laden air.

* * * * *